US008955613B2

(12) United States Patent
Randa

(10) Patent No.: US 8,955,613 B2
(45) Date of Patent: Feb. 17, 2015

(54) PNEUMATIC IMPACT TOOL

(75) Inventor: Mark D. Randa, Summit, WI (US)

(73) Assignee: Earth Tool Company, LLC, Oconomowoc, WI (US)

( * ) Notice: Subject to any disclaimer, the term of this patent is extended or adjusted under 35 U.S.C. 154(b) by 1184 days.

(21) Appl. No.: 12/387,471

(22) Filed: May 1, 2009

(65) Prior Publication Data

US 2009/0283285 A1 Nov. 19, 2009

Related U.S. Application Data

(60) Provisional application No. 61/126,244, filed on May 3, 2008.

(51) Int. Cl.
*E21B 7/26* (2006.01)
*E21B 4/14* (2006.01)

(52) U.S. Cl.
CPC .. *E21B 4/145* (2013.01); *E21B 7/26* (2013.01)
USPC ..... 173/91; 173/211

(58) Field of Classification Search
USPC ..... 173/91, 211, 13, 14, 133; 175/19, 29
See application file for complete search history.

(56) References Cited

U.S. PATENT DOCUMENTS 4,886,128 A * 12/1989 Roemer ..... 175/19
5,095,998 A * 3/1992 Hesse et al. ..... 173/133
7,066,279 B2 6/2006 Randa ..... 173/91

* cited by examiner

*Primary Examiner* — Hemant M Desai
*Assistant Examiner* — Nathaniel Chukwurah
(74) *Attorney, Agent, or Firm* — Tomlinson Rust McKinstry Grable

(57) ABSTRACT

A ground piercing tool as according to the invention has a front head assembly mounted on a bit shaft. A mid-portion of the bit shaft is mounted between front and rear chambers. Compressed fluid is supplied to the front chamber to form a gas spring that prevents the bit shaft from impacting against a front stop when it receives a blow from the striker. A valve is provided that includes a passage that permits communication between the front chamber and the rear chamber when the bit shaft is in a forwardmost position wherein it contacts the front stop. The valve permits compressed air to pass from the front chamber to the rear chamber, negating the gas spring when the bit shaft is in the forwardmost position.

2 Claims, 4 Drawing Sheets

PNEUMATIC IMPACT TOOL

This application claims priority of U.S. provisional application No. 61/126,244, filed May 3, 2008.

FIELD OF THE INVENTION

The invention relates to pneumatic ground piercing tools, and in particular, to a moveable chisel head assembly for a pneumatic impact tool.

BACKGROUND OF THE INVENTION

U.S. Pat. No. 7,066,279, the contents of which are incorporated by reference herein, relates to a ground piercing tool which includes a housing and an air distributing mechanism that reciprocates a striker to impact a bit shaft in response to a supply of compressed fluid. A fluid inlet tube is mounted in the bore of the striker. A rear end of the inlet tube is in communication with the distributing mechanism, wherein the housing and bit shaft cooperate to define a front chamber that decreases in volume as the chisel moves forward relative to the housing, and wherein the bit shaft has a radial passage therein that conducts compressed fluid from the inlet tube to the front chamber, which is configured to form an air spring. The present invention is an improvement to the air spring concept as expressed in U.S. Pat. No. 7,066,279 and operates in the same manner except as described hereafter.

SUMMARY OF THE INVENTION

A ground piercing tool as according to the invention has a front head assembly mounted on a bit shaft. A mid-portion of the bit shaft is mounted between front and rear chambers. Compressed fluid is supplied to the front chamber to form a gas spring that prevents the bit shaft from impacting against a front stop when it receives a blow from the striker. A valve is provided that includes a passage that permits communication between the front chamber and the rear chamber when the bit shaft is in a forwardmost position wherein it contacts the front stop. The valve permits compressed air to pass from the front chamber to the rear chamber, negating the gas spring when the bit shaft is in the forwardmost position.

A ground piercing tool according to a preferred form of the invention comprises an elongated tubular tool body having a front anvil having a lengthwise bore therein. A striker is disposed for reciprocation within an internal chamber of the body to impart impacts to an impact surface of the anvil for driving the tool forwardly through the ground. At the front of the tool is a chisel including a front head and a rearwardly extending bit shaft slidably disposed in the bore of the anvil. The chisel is movable between a rearward position at which a rear end portion of the bit shaft protrudes from the bore of the anvil to receive an initial impact from the striker, and a forward position at which the striker impacts on a rear impact surface of the anvil.

The striker is reciprocated by a distributing mechanism in response to a supply of compressed fluid, wherein the body and bit shaft cooperate to define a front chamber that decreases in volume as the chisel moves forward relative to the body and a rear chamber that increases in volume as the chisel moves forward relative to the body. The distributing mechanism includes passages that conduct compressed fluid to the front chamber, which is configured to form a gas spring using such compressed fluid, and a valve that permits communication between the front chamber and the rear chamber when the bit shaft is in a forwardmost position wherein it contacts a front stop. This permits compressed air to pass from the front chamber to the rear chamber, negating the gas spring when the bit shaft is in the forwardmost position. By this means the bit shaft remains in its forwardmost position, preventing unwanted impacts of the bit shaft against the stop. These and other aspects of the invention are discussed further in the detailed description which follows.

BRIEF DESCRIPTION OF THE DRAWINGS

In the accompanying drawings, wherein like numerals denote like elements.

DETAILED DESCRIPTION

Figure 1:
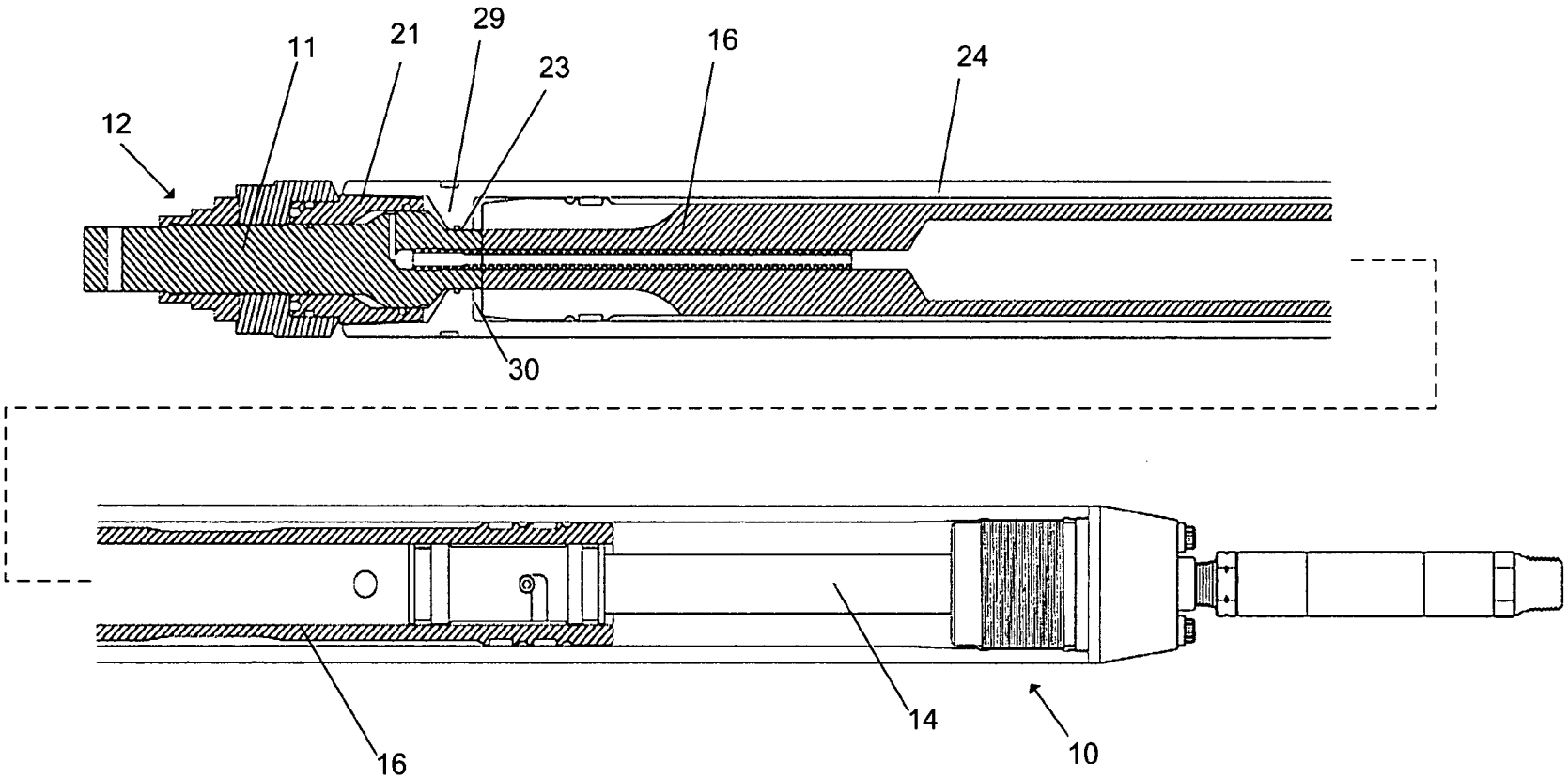
FIG. 1 is a lengthwise view, partly in section, of a piercing tool according to the invention.
Figure 2:
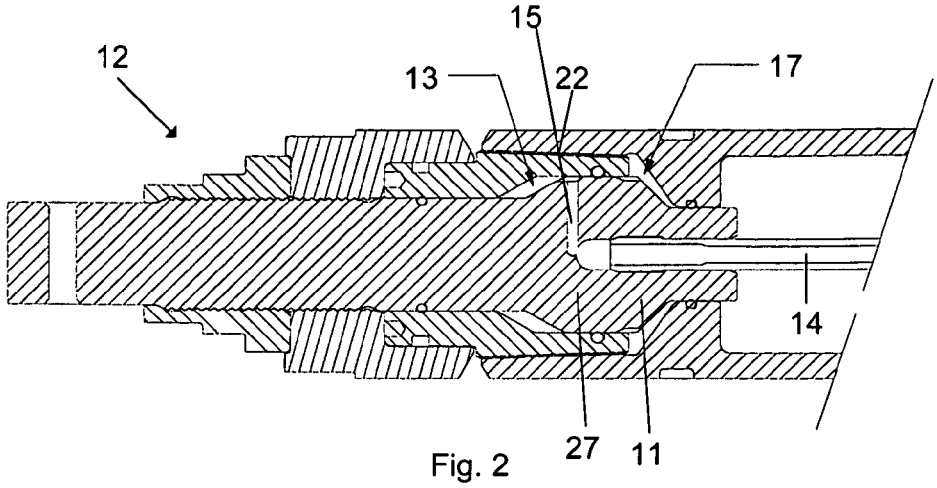
FIG. 2 is a lengthwise sectional view of a bit shaft and head assembly of FIG. 1 in a reset rear position.
Figure 3:
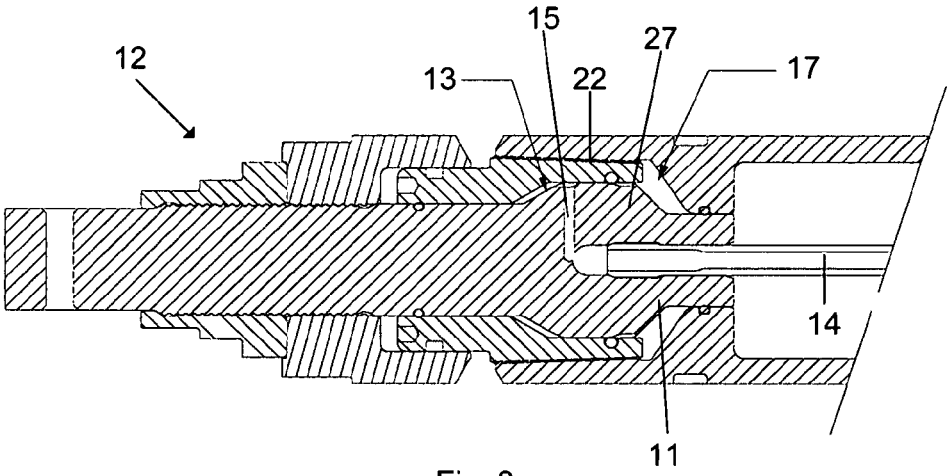
FIG. 3 is a lengthwise sectional view of the bit shaft and head assembly of FIG. 1 in an extended position.

In FIG. 1 of the accompanying drawings, a tool 10 of the invention is shown in lengthwise section. Partial sectional views of FIGS. 2 and 3 show tool 10 according to the invention in normal operation. A bit shaft 11 and head assembly 12 move back and forth from a reset rear position as shown in FIG. 2 to an extended position as shown in FIG. 3. A rear end portion of bit shaft 11 slides along the inside of a bore 23 of an anvil portion 29 of a tool body 24. The read end of bit shaft 11 can protrude from the rear anvil surface 30, become flush with it, or slide to a forward position wherein it is recessed beneath surface 30.

As described in U.S. Pat. No. 7,066,279, the air pressure supplied to forward chamber 13 through inlet tube 14 and radial passage 15 supplies the resetting force to hold the bit shaft 11 and head assembly 12 in the rear position after an impact from the striker 16 moves bit shaft 11 and head assembly 12 to the extended position shown in FIG. 3. Rear chamber 17 remains at zero (atmospheric) pressure.

Figure 4:
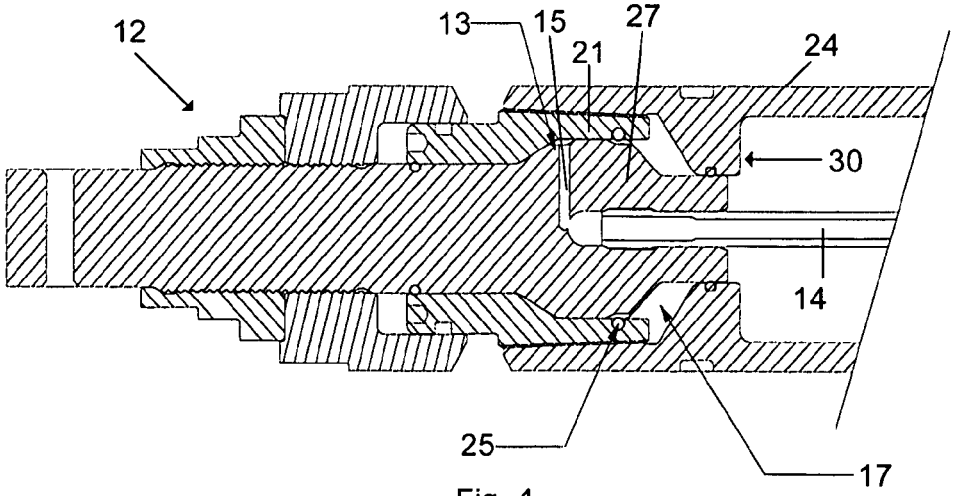
FIG. 4 is a lengthwise sectional view of the bit shaft and head assembly of FIG. 1 in a fully extended position.
Figure 5:
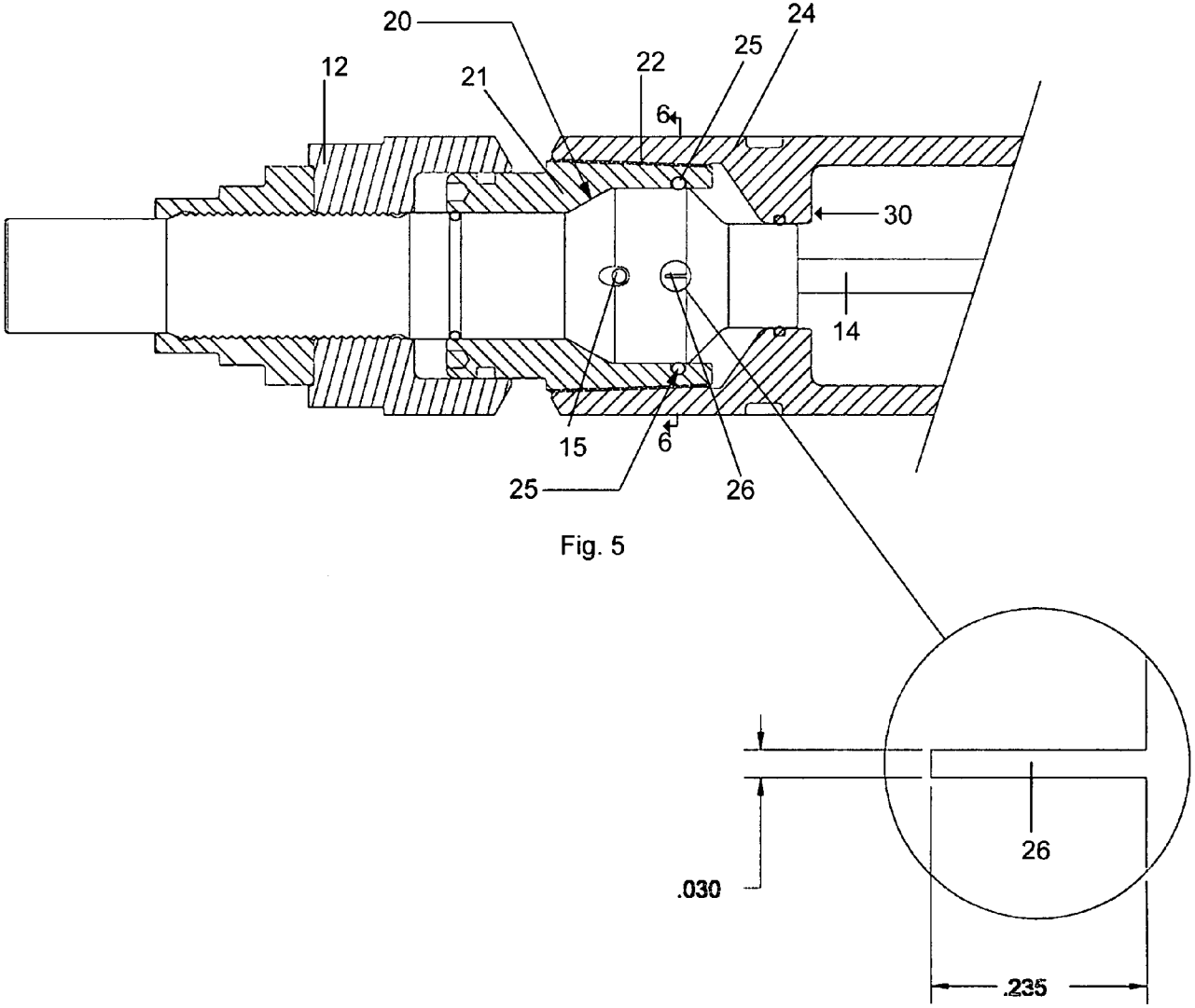
FIG. 5 is a lengthwise cutaway view of the bit shaft and head assembly of FIG. 1 in a fully extended position.
Figure 6:
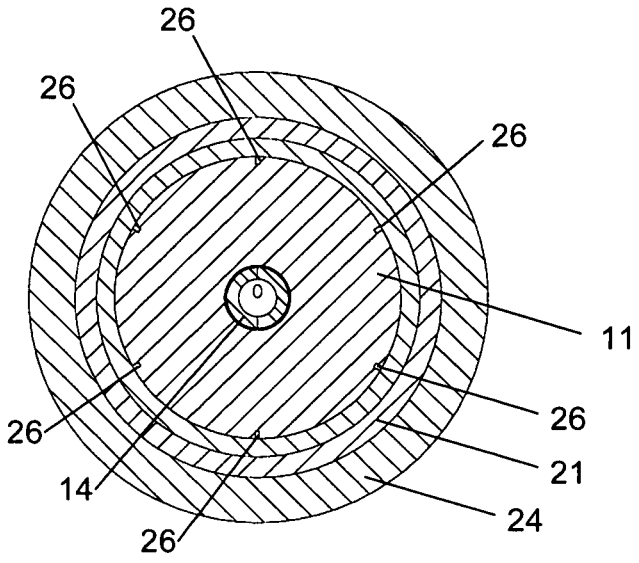
FIG. 6 is a cross sectional view taken along line 6-6 in FIG. 5.

FIG. 4 shows the bit shaft 11 and head assembly 12 in a fully extended position. FIG. 5 shows a cutaway of the bit shaft/head assembly in a fully extended position, and reveals the detail of a set of six vents 26 which open on the rear edge of a cylindrical midportion 27 of bit shaft 11 which acts as a valve and forms a seal 25 as it slides against the inner surface of a tubular bushing 21 threadedly secured to the inside of tool body 24. When the tool 10 exits the ground, the striker 16 generally impacts the bit shaft 11 and accelerates it into the stop 20 on a bushing 21 threadedly secured to the tool body 24 as shown in FIG. 5, whereas in normal operation the bit shaft 11 does not impact the stop 20. In the previous design, the sudden deceleration caused by the bit shaft 11 impacting stop 20 had deleterious effects on the threaded joint 22 at the front of the tool body 24. As a result, either this joint 22 will loosen, or various parts may fracture.

According to the invention, when the seal 25 reaches the position shown in FIGS. 4 and 5, a rear end portion of front bushing 21 passes over a set of thin vent grooves 26 in the enlarged diameter mid-section of bit shaft 11. Pressure is thereby allowed to bypass seal 25 and defeat the resetting force of the air spring in normal operation. Pressure in rear chamber 17 reaches 100 psi (operating pressure) when the bit shaft 11 is fully extended such that the rear face of bit shaft 11 is displaced beneath the anvil surface 30 on tool body 24. This forces the bit shaft 11/head assembly 12 to the forwardmost position as shown in FIGS. 4 and 5. With the bit shaft 11/head assembly 12 in this position, the striker 16 does not impact bit shaft 11, and therefore bit shaft 11 is not accelerated into the stop 20 on the front bushing 21. Bushing 21 is threadedly secured to the tool body 24 and functions as part of the tool body. The anvil that provides anvil surface 30 may be formed by machining the tool body from a solid bar, or may be a separate piece mounted as by a press-fit in the front of the tubular tool body.

Seal 25 is a plastic or elastomeric ring that is in sliding, air-tight engagement with the outside surface of cylindrical mid-portion 27 of bit shaft 11. As a groove 26 passes over it, contact between the ring and the groove tends to abrade the ring and gradually wear it out. To minimize this, it is preferred according to the invention to use a plurality (six in this example) of grooves 26 that are narrow and shallow as compared to a single groove having the same cross-sectional area. A groove width of 0.03" or less and a depth of 0.05" or less are preferred, and the length of each groove 26 slightly exceeds the thickness of seal ring 25. It is possible, in the alternative, to drill a bypass passage through bit shaft 11 that would accomplish the same result as grooves 26, but such would be more difficult to fabricate and is not preferred.

Once the tool 10 is made ready for use again, with compressed air supply turned off, chamber 17 returns to atmospheric pressure. Head assembly 12 will be in contact with the ground or the like, and head assembly 12 and bit shaft 11 return to the position shown in FIG. 2. The bypass vents 26 are thus positioned to allow compressed air to enter rear chamber 17 only when bit shaft 11 is in a forwardmost position wherein the rear end of bit shaft is displaced beneath anvil surface 30 and able to impact against the front shoulder or stop 20 in front chamber 13. Seal 25, the surface of cylindrical mid-portion 27 and vent grooves 26 together form a valve that controls the flow of compressed fluid between the front and rear chambers 13, 17.

It will be evident to one skilled in the art that the positions of seal 25 and grooves 26 could be reversed, i.e., the seal ring is mounted on the bit shaft and the grooves are formed on the inside of bushing 21. These and other such variations are within the scope of the invention.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

The invention claimed is:

1. A ground piercing tool, comprising an elongated tubular tool body, including a front anvil having a lengthwise bore therein;

a striker disposed for reciprocation within an internal chamber of the body to impart impacts to a rearward impact surface of the anvil for driving the tool forwardly through the ground;

a chisel including a front head and a rearwardly extending bit shaft slidably disposed in the bore of the anvil, which chisel is movable between a rearward position at which a rear end portion of the bit shaft protrudes from the bore of the anvil to receive an initial impact from the striker, and a forward position at which the striker impacts on a rear impact surface of the anvil;

a distributing mechanism that reciprocates the striker in response to a supply of compressed fluid;

wherein the body and bit shaft cooperate to define a front chamber that decreases in volume as the chisel moves forward relative to the body and a rear chamber increases in volume as the chisel moves forward relative to the body and a rear chamber, the distributing mechanism including one or more passages that conduct compressed fluid to the front chamber, which front chamber is configured to form a gas spring using such compressed fluid; and a valve including a passage that permits communication between the front chamber and the rear chamber when the bit shaft is in a forwardmost position wherein it contacts a front stop, which valve permits compressed air to pass from the front chamber to the rear chamber, negating the gas spring when the bit shaft is in the forwardmost position.

2. The tool of claim 1, wherein when the bit shaft is in the forwardmost position, a rear end of the bit shaft is displaced beneath a rearwardly facing anvil surface that receives impacts from the striker.

* * * * *